US006126449A

United States Patent [19]

Burns

[11] Patent Number: 6,126,449

[45] **Date of Patent: *Oct. 3, 2000**

[54] INTERACTIVE MOTION TRAINING DEVICE AND METHOD

[75] Inventor: Dave Burns, Los Angeles, Calif.

[73] Assignee: Swing Lab, Berkeley, Calif.

[ * ] Notice: This patent is subject to a terminal disclaimer.

[21] Appl. No.: 09/276,399

[22] Filed: Mar. 25, 1999

[51] Int. Cl.[7] ..... A63B 69/00

[52] U.S. Cl. ..... 434/252; 473/131

[58] Field of Search ..... 434/247, 252; 473/131, 136, 140, 141, 150, 151; 482/1–9, 900, 901, 902

[56] References Cited

U.S. PATENT DOCUMENTS

| | | | |
|---|---|---|---|
| 4,891,748 | 1/1990 | Mann | 364/410 |
| 5,111,410 | 5/1992 | Nakayama et al. | 364/551.01 |
| 5,184,295 | 2/1993 | Mann | 364/410 |
| 5,249,967 | 10/1993 | O'Leary et al. | 434/247 |
| 5,486,001 | 1/1996 | Baker | 434/252 X |
| 5,513,991 | 5/1996 | Reynolds et al. | 439/81 |
| 5,603,617 | 2/1997 | Light | 434/252 |
| 5,638,300 | 6/1997 | Johnson | 364/551.01 |
| 5,772,522 | 6/1998 | Nesbit et al. | 473/222 |
| 5,823,786 | 10/1998 | Easterbrook | 434/247 |
| 5,857,855 | 1/1999 | Katayama | 434/247 |

OTHER PUBLICATIONS

Videotape showing how the invention works.

Biovision advertisement along with a copy of Scott Thompson's letter.

*Primary Examiner*—Kien T. Nguyen

*Attorney, Agent, or Firm*—Michael A. Glenn

[57] ABSTRACT

The present invention provides a motion template, a motion training device, a network of devices, and a method for enabling a student to interactively emulate in real time the dynamic motion of an instructor performing a selected motion. The device includes a video camera configured to transmit a real time background having a live image of the student dynamically performing the selected motion. A monitor is configured for viewing by the student while performing the selected motion. A motion template has a stored image of an instructor dynamically performing the selected motion. The device also includes means for superimposing the motion template onto the real time background and simultaneously displaying the resulting combination of the motion template and the real time background scene on the monitor. The device can further be one or many devices connected in a network sharing access to a database containing a library of motion templates of different instructors who are top performers in their field.

34 Claims, 6 Drawing Sheets

INTERACTIVE MOTION TRAINING DEVICE AND METHOD

FIELD OF THE INVENTION

The present invention relates to a method and device, or network of devices, for motion training through interactive and instantaneous feedback with a dynamic, instructive motion template.

BACKGROUND OF THE INVENTION

Motion training is taught daily to millions of people. The methods most often employed rely on an instructor verbally directing a student to recognize the desired positions and sequencing of the motion strictly by feel and through the comments of the instructor. For the average person, this process can be difficult and is often unrewarding.

In order to improve performance, athletes in sports and participants in recreational activities often concentrate on improving their skills through repetitive practice. A number of devices for the repetitive practice of an athletic movement or action have been developed. Examples of these devices include batting practice machines for baseball, ball serving machines for tennis, and ball return putting targets and swing trainers for golf. These are just a few examples of the literally hundreds of practice devices which have been developed to improve a participant's skills.

A number of these practice devices use a visual system that provides overlays by superimposing two recorded video representations of the same activity. Such systems are shown, for example, in Michaels et al. U.S. Pat. No. 4,015,344, Haas et al. U.S. Pat. No. 4,137,566, McCullough et al. U.S. Pat. No. 3,408,750, and Seidel et al. U.S. Pat. No. 4,828,500.

These references make use of a directly recorded image of an instructor, such as on video tape, taken while the instructor is performing a particular motion technique. The student is provided with a means of overlaying an image of his own recorded technique against that of the instructor in order to determine what deviations exist. These systems, however, are not interactive and do not provide instantaneous feedback. Only after the student has completed practicing the technique is a comparison made to the instructor's video form.

These systems are also difficult to use and to calibrate. Because of the different sizes and positions of the images, it is hard to exactly overlay the two images. Further, the two images are time based. That is, because they are dynamic representations of the sports activity, in order to be useful to the student the movements must take place at the same relative time. Synchronizing the recorded images of the instructor and student to start and proceed through the motion at the same pace requires expensive editing which alters the natural pace of either the instructor's or student's motion, decreasing its teaching value.

Another type of system is shown in Mann, U.S. Pat. No. 4,891,748 which generates an image model representing the cumulative technique of several golf instructors. The image is scaled, by the computer, to the size of the student's image and is available in ten key positions at intervals through the golf swing. The computer brings up a static display for the student to reach and be placed in a stationary position to demonstrate the feel of the position. The composite image eliminates the poor movement patterns that elite performers display and does not demonstrate the tempo and rhythm of their motion. The Mann disclosure also uses a live teacher's assistance in digitizing the student's image and emphasizes the verbal directives of a teacher to the student.

Still another system shown in O'Leary et al., U.S. Pat. No. 5,249,967 uses a video overlay generator to produce a static image representing the dynamic technique of a master and overlays the live image of the student for a simultaneous display on a visual monitor. The system is specifically designed not to force the student to keep pace with a moving image of the master. Precision of position, and not pace, is the focus of this method. Only the positions of the body's extremities can be examined and emulated with this method. The O'Leary disclosure ignores centers of body movement such as the large muscle groups in the legs and torso.

Another problem with the prior art methods of teaching sport skills is that there is no standardization in the technique which is taught or of methodology used to teach the technique. Several of these prior art methods use an artificially-created, "composite" or "average" training motion to provide standardization. However, this ideal motion simply embodies one person's subjective interpretation of what motion is ideal. Furthermore, every top performer has a technique which he or she uses personally to achieve their level of proficiency in the sport and is adapted to his or her specific gender, size, and weight. Adjusting one ideal motion to students of varying size and weight for the sake of standardization only further distorts the artificial ideal motion from the real motion of a top performer.

Thus, a need exists for a simple, inexpensive and easy-to-use motion training system which allows the student, with or without an instructor, to practice a selected motion by comparing him or herself in real time against a moving top performer of the motion having the same gender and approximately the same age and body type as the student. Preferably, the student would observe the top performer at the pace that the motion is normally performed. A customized presentation of referential graphics would guide the student through the correct positions of the activity which are in many cases never achieved after years of traditional instruction.

SUMMARY OF THE INVENTION

The present invention provides a motion training template for a device enabling a student to interactively emulate in real time the dynamic motion of an instructor performing a selected motion on a monitor simultaneously displaying the student in real time. The monitor is configured for viewing by the student while performing the selected motion. The motion template includes an image sequence of an instructor dynamically performing the selected motion retrievably stored on a storage media. The image sequence is configured for superimposing onto the real time background and for simultaneously displaying the resulting combination of the image sequence and the real time background scene on the monitor. The view of the image sequence has the same camera angle as the real time background.

The present invention also provides a motion training device for enabling a student to interactively emulate in real time the dynamic motion of an instructor performing a selected motion. The device includes a video camera configured to transmit a real time background including a live image of the student dynamically performing the selected motion. A monitor is configured for viewing by the student while performing the selected motion. A motion template has a recorded image of an instructor dynamically performing the selected motion. The device also includes means for superimposing the motion template onto the real time background and simultaneously displaying the resulting combination of the motion template and the real time background scene on the monitor.

Two or more motion training devices can also be standardized to form a network which shares access to a database containing a library of motion templates of different instructors who are top performers in their field. Preferably, the motion template is a stored image sequence of a top performer having approximately the same gender, age, and body type as the student and with the same view as the real time background.

The present invention provides another embodiment of a motion training device for enabling a student to interactively emulate in real time the dynamic motion of an instructor which includes a video camera configured to transmit a real time background including a live image of the student dynamically performing a selected motion. A monitor is configured for viewing by the student while performing the selected motion. A motion template has a stored image of an instructor dynamically performing the selected motion. The view of the stored image of the instructor is the same as the view of the real time background provided by video camera wherein the video camera has the same lens characteristics and relative position as the camera used in creating the stored image. The device also includes means for superimposing the motion template onto the real time background, simultaneously displaying the resulting combination of the motion template and the real time background scene on the monitor, and automatically repeating the motion template at a predetermined interval.

The present invention also provides a programmed computer for motion training by enabling a student to interactively emulate in real time the dynamic motion of an instructor. The computer includes an input signal from a video camera configured to transmit a real time background including a live image of the student dynamically performing a selected motion. An output signal to a monitor is configured for viewing by the student while performing the selected motion. A motion template is provided which has a recorded image of an instructor dynamically performing the selected motion. The computer also includes means for superimposing the motion template onto the real time background and simultaneously displaying the resulting combination of the motion template and the real time background scene on the monitor.

The present invention further provides a method of training a student to emulate the dynamic motion of an instructor which includes the step of enabling the student to quantitatively compare the live image of a student performing a selected motion with a motion template having a stored image of the instructor dynamically performing the selected motion. Preferably, the method includes the steps of: superimposing a motion template having a stored image of the instructor dynamically performing a selected motion over a real time background including a live image of the student dynamically performing the selected motion; and, displaying the superimposed stored and live images for the student to observe while dynamically performing the selected motion.

An object of the present invention is to coordinate the timing of a top performer through an instructive motion template illustrating muscular motion with the movements of a student in real time using visual cues, and optionally audio cues, by integrating a dynamic instructive motion template into a real time background.

It is a further object of the present invention to provide a tangible goal and instantaneous recognition of correct or improper body movement while repeatedly practicing a training motion through the interaction created by combining the live or real time motion of a student with a dynamic instructive template.

Another object of the present invention is to provide a student the ability to immediately discern if his or her movement properly emulates an instructive motion template even if the practice session is unsupervised by a live instructor.

A further object of the present invention is to provide an instructive motion training device which standardizes a teaching technique that can be uniformly implemented and exactly replicated from student to student regardless of the supervision.

Still another object of the present invention is to provide a system which can be readily used indoors or outdoors and has the flexibility to accommodate different types of instructive templates modeled after various instructors using different types of sporting equipment, i.e. different golf pros using woods, irons, putter, etc.

Other and further advantages, embodiments, variations and the like will be apparent to those skilled-in-the-art from the present specification taken with the accompanying drawings and appended claims.

BRIEF DESCRIPTION OF THE DRAWINGS

In the drawings, which comprise a portion of this disclosure.

DESCRIPTION OF THE PREFERRED EMBODIMENTS

Figure 1A:
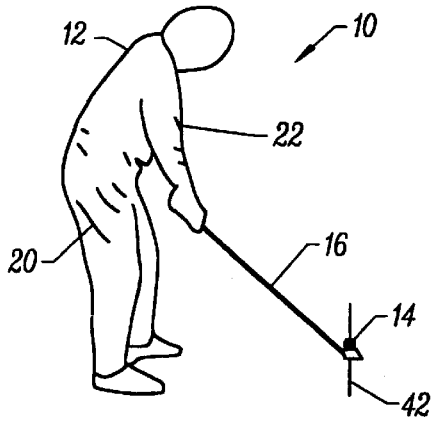
FIGS. 1A–1F illustrate representative frames of an animated outline of an instructor's recorded image at various intervals in a motion template sequence.

The present invention is utilized for training motion used in various sports, physical therapy, or in a workplace environment. The present invention is particularly useful in training a motion sequence in which the positions of the body and its limbs, as well as sport, therapy, or work equipment, are to be compared during the motion sequence.

In the workplace, a worker's safety may be protected or a gain in production efficiency may result from performing a repetitive motion accurately. Physical therapy can be more effective when exercising a specific muscle needing therapy through a particular motion. With a sporting activity, a participant may be able to improve his or her skill or avoid an injury.

In many repetitive motion activities, the larger muscles of the body preferably do most of the work. Golf, tennis, baseball, football, basketball, running, tai chi, and many physical therapies, to name a few, are based on fundamentals which state that the correct positioning of the body as a whole is of paramount importance to the successful completion of the intended act. Even if the perceived action (i.e. throwing a baseball) is performed by the joints or extremities, it usually is the proper sequence of movements by the large muscles of the body which have brought those joints and extremities into the correct alignment with the appropriate timing of execution. In fact, many problems in sports requiring a skill set such as golf, tennis, and baseball, where to even hit the ball, the extremities can only be in relatively correct alignment, are attributable to the larger muscles of the body moving in ways that are subtly counterproductive to maximum impact. Incorrect motion existing solely in the movements of the joints and extremities (i.e. poorly timed rolling of the forearms in a golf swing) is more clearly demonstrated to the student with the present invention than with point and line animation. The student can see the actual shapes of the limbs in question moving in concert with one another. Interpretation of dots and lines is unnecessary. The expense of digitizing the student's image is avoided.

Although the present invention will now be described with regard to golf swing training, this is but one example. The present invention may also be used for, but is not limited to, training strokes or serves in tennis, throwing or kicking a football, pitching or hitting in baseball, running, fly rod casting, etc.

FIGS. 1A–F are representative frames at various points along a complete sequence of a motion template, generally designated as reference numeral 10. An outline animation 12 of the whole body of a professional or expert instructor executing an ideal motion for a golf swing is one embodiment representing the instructor's image.

Specifically, FIG. 1A illustrates the instructor addressing a golf ball 14 with a golf club 16 at the start of a golf swing sequence. Preferably, the outline animation 12 is enhanced with visual cues, generally designated as reference numeral 18, such as highlighting selected contours or surface features of the instructor's body or clothing. For example, the animation highlights may be the highlighted creases 20 along the thigh of the instructor's pants or the bend in the elbow 22. As will be described later, the visual cues 18 provide the student with visual assistance in matching corresponding contours or surface features of the student's body as the motion template dynamically progresses through its sequence.

Figure 1B:
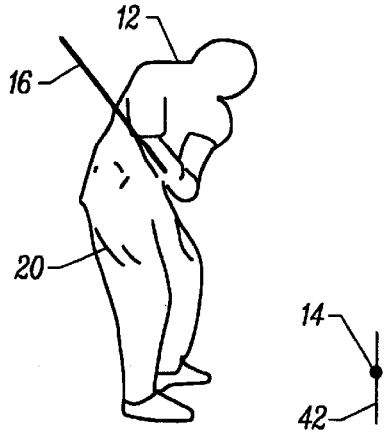

FIG. 1B illustrates the animation outline 12 starting a backswing motion by drawing the club 16 away from ball 14. The backswing of the club 16 continues through FIGS. 1B and 1C until the recorded image of the instructor reaches the top of the backswing in FIG. 1D. FIG. 1E shows the downswing of the club 14 through the ball 16 with the completion of the golf swing in the final sequence of the motion template 10 in FIG. 1F.

The visual cues 18 change as the motion template 10 progresses through its sequence to provide assistance to the student in matching corresponding contours or surface features of the student's body with the motion template 10. The visual cues 18 also allow individual parts of the animation outline 12 in the motion template 10 to be emphasized at the appropriate time during the sequence.

Figure 1C:
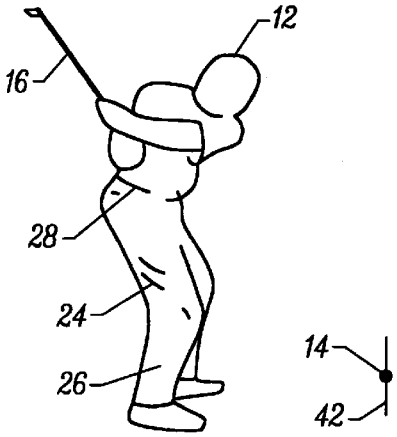
Figure 1D:
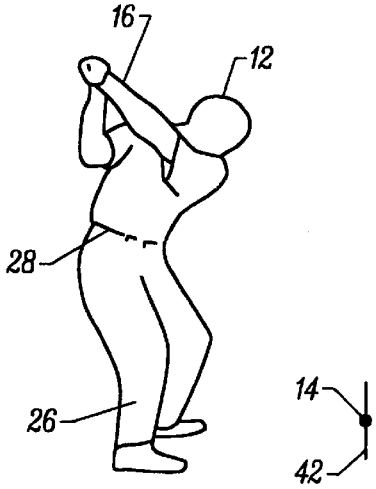
Figure 1E:
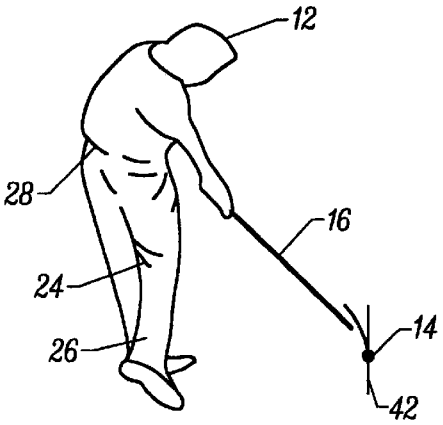
Figure 1F:
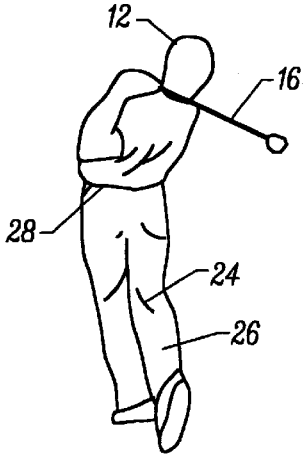

For example, FIG. 1C emphasizes the highlighted flexing 24 of the back leg 26 of the instructor's recorded image and introduces a highlighted belt 28. In FIG. 1D, the highlighted flexing 24 of the back leg have been removed and the emphasis is placed on the twisting of the highlighted belt 28.

Figure 2A:
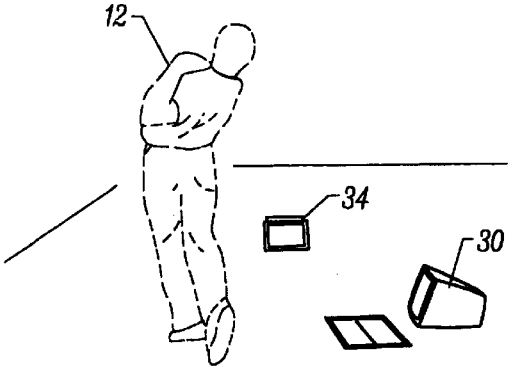
FIGS. 2A–2F illustrate representative frames of an animated outline of an instructor's recorded image at various intervals in a motion template sequence as seen in FIGS. 1A–1F superimposed on a live image background visually observed by a student.

FIGS. 2A–2F illustrate the present invention in operation and the reference numerals denote similar items as described in other figures. FIG. 2A is the animation outline 12 of the motion template superimposed on a background provided by a live image feed from a video camera (not shown) standing behind the practice area. A first monitor 30 rests on the ground behind a practice mat 32 and an optional second monitor 34 rests on the foreground of the practice area. The animation outline 12 is shown in final frame of the motion template 10 sequence. FIGS. 2A–2F also show what is visually observed in the first and second monitors 30, 34.

Figure 2B:
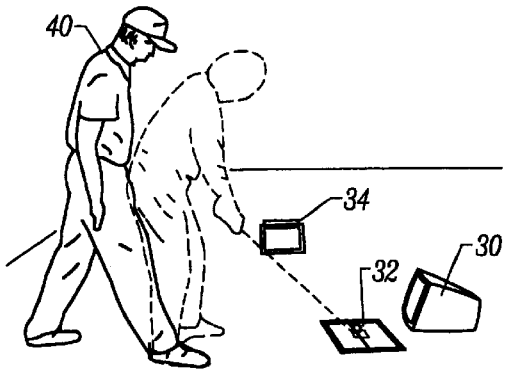

In FIG. 2B, the motion template 10 is reset to the first frame of the sequence and the animation outline 12 is shown addressing the ball 16 at the start of the golf swing. A student 40 is shown stepping into the animation outline 12. The student adjusts his position by observing his live image in the first monitor 30 which is appropriately tilted to be in a direct line of sight as the student looks downward to the ball mark on the mat 32.

Figure 2C:
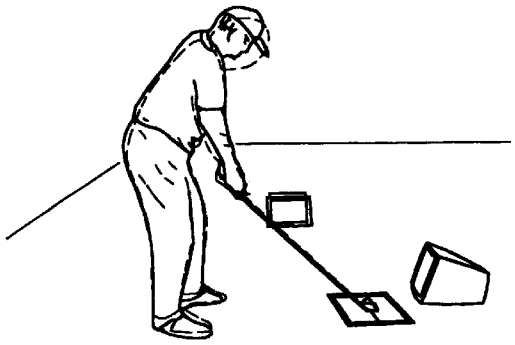

FIG. 2C shows the student 40 adjusting his position to match the corresponding outline, contours, and surface features of the instructor's animation outline 12. For example, the highlighted creases 20 indicate to the student 40 the correct position and slant of the student's thighs. The motion template 10 is ready to start its sequence either automatically in response to a preset time period or manually at the control of the student 40 or a live instructor observing the training session.

Figure 2D:
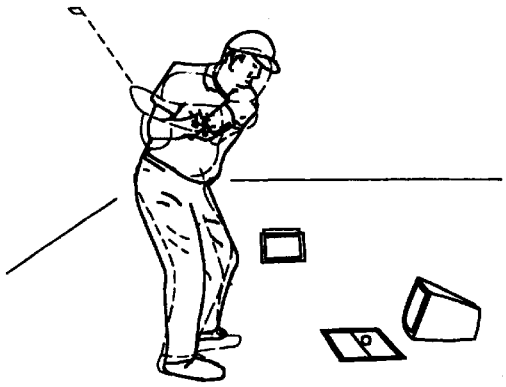
Figure 2E:
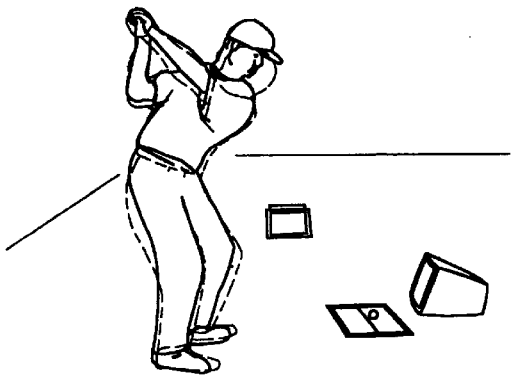
Figure 2F:
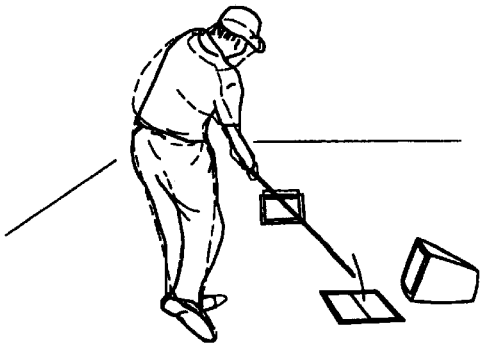

Preferably, a sound cue or visual cue (such as a trembling outline 12) indicates to the student 40 that the dynamic sequence of the motion template 10 is about to start. The motion template 10 then begins the movement of the animation outline 12 at normal speed as the backswing of the student 40 and animation outline 12 are shown in FIGS. 2D and 2E which are representative frames of a dynamic sequence. FIG. 2F shows the downswing of the animation outline with the student 40 following along while observing his progress by viewing the real time comparison of the student's form with the animation outline 12 in the first monitor 30.

The golf swing is completed as shown by the animation outline 12 in FIG. 2A. The second monitor 34 may be appropriately positioned in the practice area foreground and tilted for the student 40 to directly observe his or her final position at the end of the golf swing. The motion template 10 automatically resets to the first frame of its sequence and the student is ready to start a new swing as shown in FIG. 2C. The student 40 can preset the amount time the motion template 10 waits before starting the sequence again.

Preferably, sound cues are used to help the student synchronize his or her movement with the animation outline 12. Examples of these sounds are the "pop" when the club strikes the ball, the "swoosh" of the club on the downswing, etc. The sounds may also be verbal reminders such as "keep the head steady". The sounds are preferably part of the motion template, but may be added by another independent source. These sounds may be synthetic or the actual sounds recorded along with the image from which the animation is derived.

The motion template 10 is preferably an animated outline of the instructor's image (the selected top performer) although other forms representing the movements of the instructor are suitable. For example and not limitation, the instructor's image may be an opaque moving overlay. The opacity can be adjusted to provide contrast to other visual features within the outline such as surface contour which is described in more detail below. The animation may be achieved manually by simply tracing a video recording of the desired movement frame by frame, with the use of edge sensors, or by digitizing the instructor's image with a computer, to name but a few different techniques.

The motion template 10 illustrated in FIGS. 1A–1F and 2A–2F is one recorded view. The view is defined by a camera's lens characteristics and position. The position of the camera is defined by its angle and distance to the object. The object selected can be the body of the instructor or student 40, or the position of a line-of-play 42 or the ball mark.

It should be understood that the present invention can use motion templates 10 which present different views recorded from different camera angles. For example, a view from behind or in front of the student 40 places the camera angle roughly perpendicular to the line-of-play 42, a top view places the camera looking downward at the student's head, and a side view of the student 40 places the camera angle roughly parallel to the line-of-play 42 and in front of or behind the practice mat 32.

The camera angle from which the motion template 10 is recorded is the same angle as the video camera providing a live feed to the first monitor 30. For example, FIGS. 1A–1F present a recorded motion template at a camera angle from the side of the instructor behind the practice mat 32. That is also the camera angle of the video camera providing the live feed.

Preferably, the entire view from which the motion template 10 is recorded is the same view as the video camera providing a live feed to the first monitor 30. To this end, the lens characteristics and position of the camera used to record the motion template 10 should be the same as the lens characteristics and position of the camera used to provide the live feed of the student. The resulting images of the instructor in the motion template 10 and the student are then the same scale. When the instructor's image in the motion template 10 is a top performer having the same gender and approximately the same age and body type (height, weight, etc.) as the student, the sizes of the instructor and the student are nearly identical. This allows the student to "step into" the image of the instructor.

As is known to those skilled in photography, the cameras used to shoot the motion template 10 and student may have different lenses and be different distances from the instructor and student, respectively, and still yield images of the instructor and student having the same scale. Scale refers to the proportion of two images.

If the motion template 10 and the student can not be delivered from cameras providing the same scale, other techniques are available. Often the scaling can be manually accomplished by adjusting the distance of the live feed video camera to the student performing the training method so that the size of the image of the student approximates the size of the motion template 10. Another technique uses a zoom lens on the live feed video camera to scale the size of the image of the student.

In an alternate embodiment, the recorded image of the instructor in the motion template 10 is scaled, such as by a computer, to the size of the student's image. Several scaling techniques are available commercially in animation software. One scaling technique is described by the prior art specifically identified above.

Figure 3:
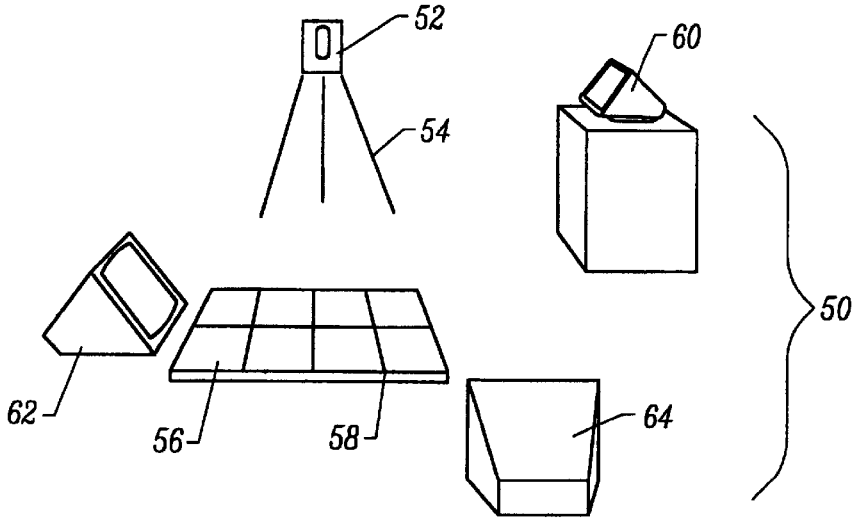
FIG. 3 is one embodiment of a motion training device of the present invention.

One embodiment of a training motion device 50 is shown in FIG. 3. The device 50 includes a video camera 52 mounted on a tripod 54 and positioned to view the student (not shown) performing the training motion on a practice mat 56. On the surface of the practice mat 56 is a grid 58 to assist the student in aligning his or her feet and body appropriately. The video camera 52 provides a live feed to a computer 60 having a separate monitor located near the practice mat 56.

A first monitor 62 rests on the ground behind the practice mat 56 and a second monitor 64 rests on the foreground of the practice area relative to the video camera 52. The student adjusts his or her position by observing his or her live image in the first monitor 62 which is appropriately tilted to be in a direct line of sight as the student stands on the practice mat 56 and looks downward addressing the ball (not shown). The second monitor 64 may be appropriately positioned in the practice area and tilted for the student to directly view his or her final position at the end of the golf swing.

The computer 60 is positioned to be accessible to a live instructor during the practice session offering visual observation of the student's performance compared to the motion template. The computer 60 also provides the live instructor or student an opportunity to reversibly add visual cues to the motion template to assist the student in using the animation outline or following the live instructor's directions.

Figure 4A:
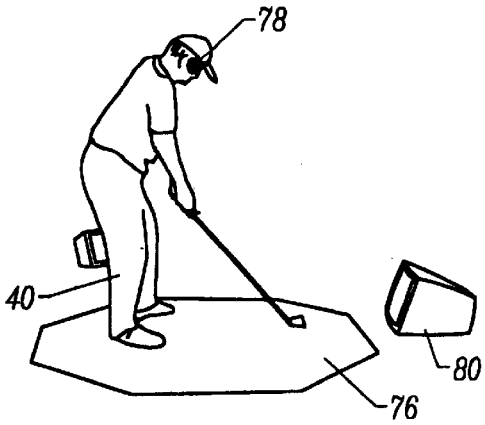
FIGS. 4A–4F illustrate representative frames of a student at various intervals in a motion template sequence and the student's swing with additional visual cues added to the scene observed by the student.
Figure 4B:
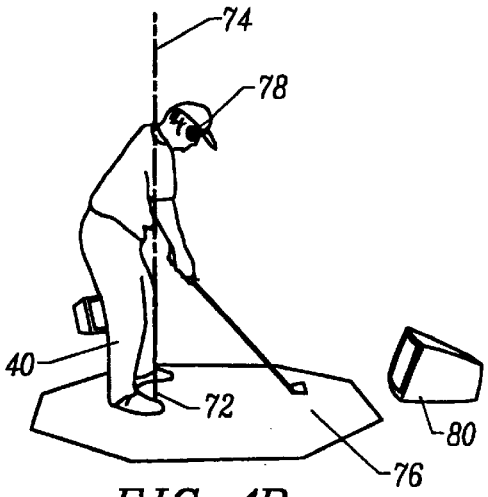
Figure 4C:
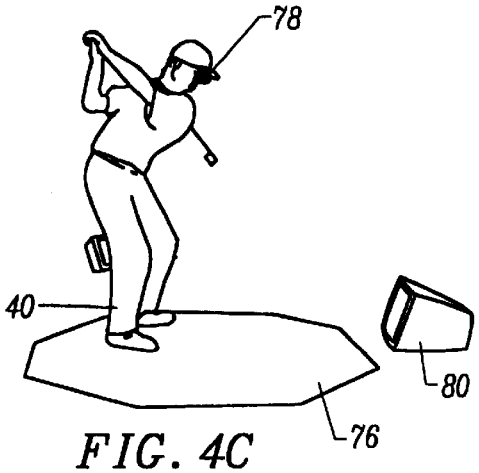
Figure 4D:
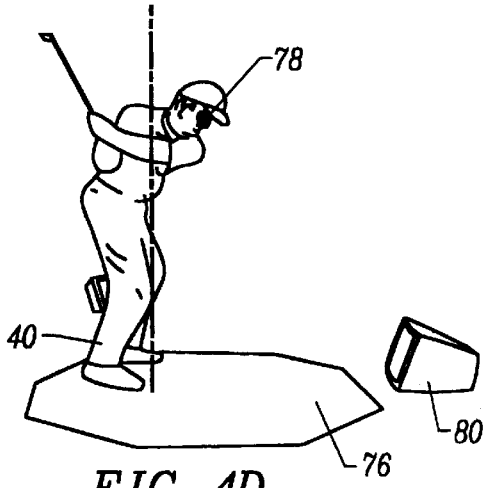
Figure 4E:
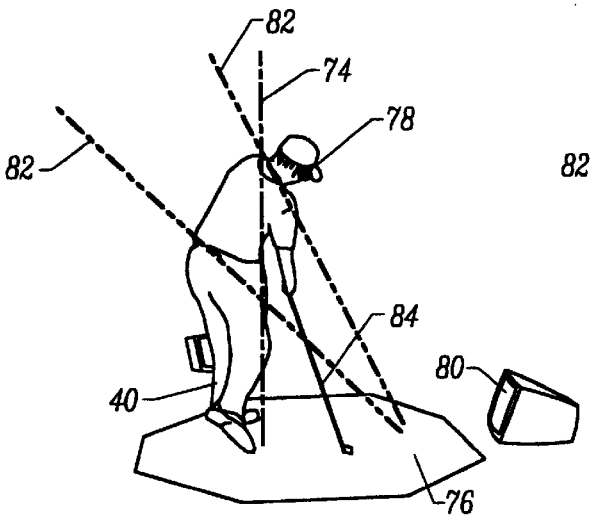
Figure 4F:
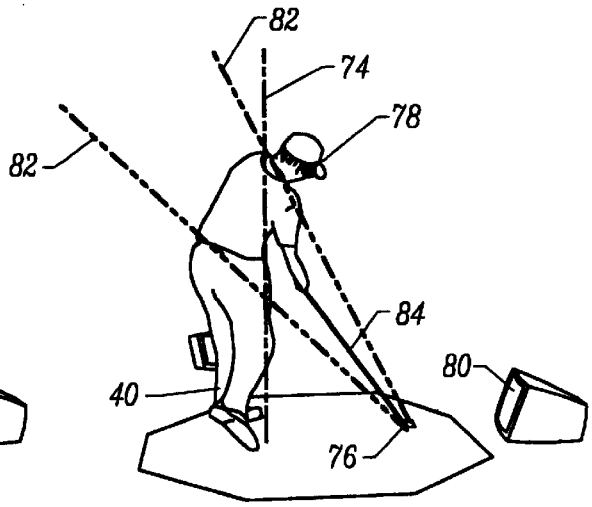

For example in FIGS. 4A–4F, a student 70 is shown in representative frames at various points along the sequence of a motion template. Specifically, FIGS. 4A and 4B illustrate the student 70 addressing a golf ball, in FIGS. 4C and 4D the student 70 is near the top of his backswing, and in FIGS. 4E and 4F the student 40 is starting the takeaway portion of the swing. FIGS. 4A, 4C, and 4E illustrate the student's swing before practicing with the present invention. FIGS. 4B, 4D, and 4F illustrate the student's swing after practicing with the present invention for a few minutes. The animation outline has been removed for the sake of clarity in illustrating the visual cues, generally designated by reference 72, which are added to the scene observed by the student 70.

In FIG. 4A, the student 70 is illustrated bent too far over at the waist with his legs too straight for a good, comfortable swing. A vertical line 74 is drawn in FIG. 4B perpendicular to the practice mat 76 through the body of the student 70 to further assist the student to avoid bending at the waist and straightening his legs during the swing. A highlighted dot 78 is added by the instructor over the eyes of the student 70 to help prevent the student from rocking his head during the swing.

As observed in FIG. 4C, the student 70 moved his head dramatically during the backswing portion of his swing as indicated by the position of the dot 78 near his left shoulder. Having the student 70 stabilize his head relative to the dot 78 as he observed his swing in the monitor 80, put the student 70 in a stronger position at the top of the backswing as observed in FIG. 4D. The student 70 benefits immediately by staying solid in his lower body and building resistance to his upper body which transfers torque from his legs to his shoulders as the downswing is started.

Another problem experienced by the student 70 during his swing is illustrated in FIGS. 4E and 4F where two lines forming a cone-like shape 82 are drawn across the body of the student 70 to indicate the correct position of the golf club 84 during the swing. The student 70 was initially whipping the club 84 away from the ball with his hands but without also turning his shoulders. As a result, the club 84 was taking a path away from the ball that was dramatically closer to the student's body than is preferred in a good swing as indicated in FIG. 4E. By taking the club 84 away from the ball within the cone 82 during the backswing, the student 70 keeps the movement of his arms and shoulders coordinated for a solid takeaway. As a result, the path of the club 84 starts in the proper position during takeaway portion of the swing in FIG. 4F. Coordinating the movement of the extremities with the movement of the torso as "one piece" develops a solid, repeatable golf swing. In the following preferred embodiment of the present invention, this lesson could be stored for later use in this device or any other device in the network.

Figure 5:
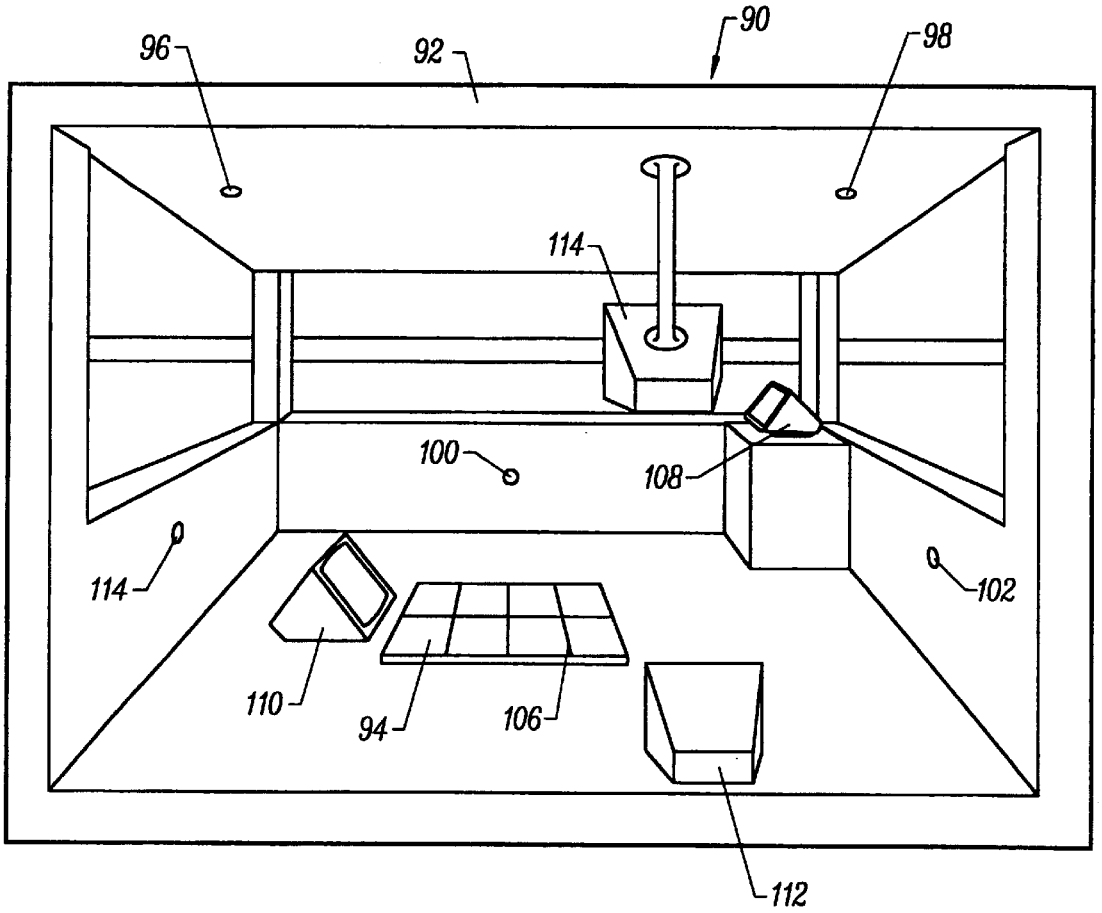
FIG. 5 is a preferred embodiment of a motion training device of the present invention utilizing video cameras to provide live images from multiple viewing angles.

A preferred embodiment of the present invention is a motion training device 90 shown in FIG. 5. The device 90 includes multiple video cameras mounted on a framework 92 and positioned to capture the student (not shown) from different views performing the training motion on a practice mat 94. Specifically, cameras 96, 98 provide top views of the motion training, camera 100 provides a side view from behind the student, camera 102 provides a back view and camera 104 provides a front view of the student. On the surface of the practice mat 94 is a grid 106 which provides a reference point for ball position and a line-of-play. The motion template 10 assists the student in aligning his or her feet and body appropriately. The video cameras 96, 98, 100, 102, and 104 provide live feeds to a computer 108 having a separate monitor located near the practice mat 94.

A first monitor 110 rests on the floor of the practice area or the surface supporting the framework 92 behind the practice mat 94 and a second monitor 112 rests near the practice area opposite the video camera 100. The student adjusts his or her position by observing his or her live image in the first monitor 110 which is appropriately tilted to be in a direct line of sight as the student stands on the practice mat 94 and looks downward addressing the ball mark (not shown). The second monitor 112 may be appropriately positioned near the practice area opposite the video camera 100 and tilted for the student to directly view his or her final position at the end of the golf swing. Optionally, another monitor 114 may be suspended from the framework 92 at the student's eye level to provide the same or different camera angle as the second monitor 112. The suspended monitor 114 may also replace the second monitor 112 entirely.

Figure 6:
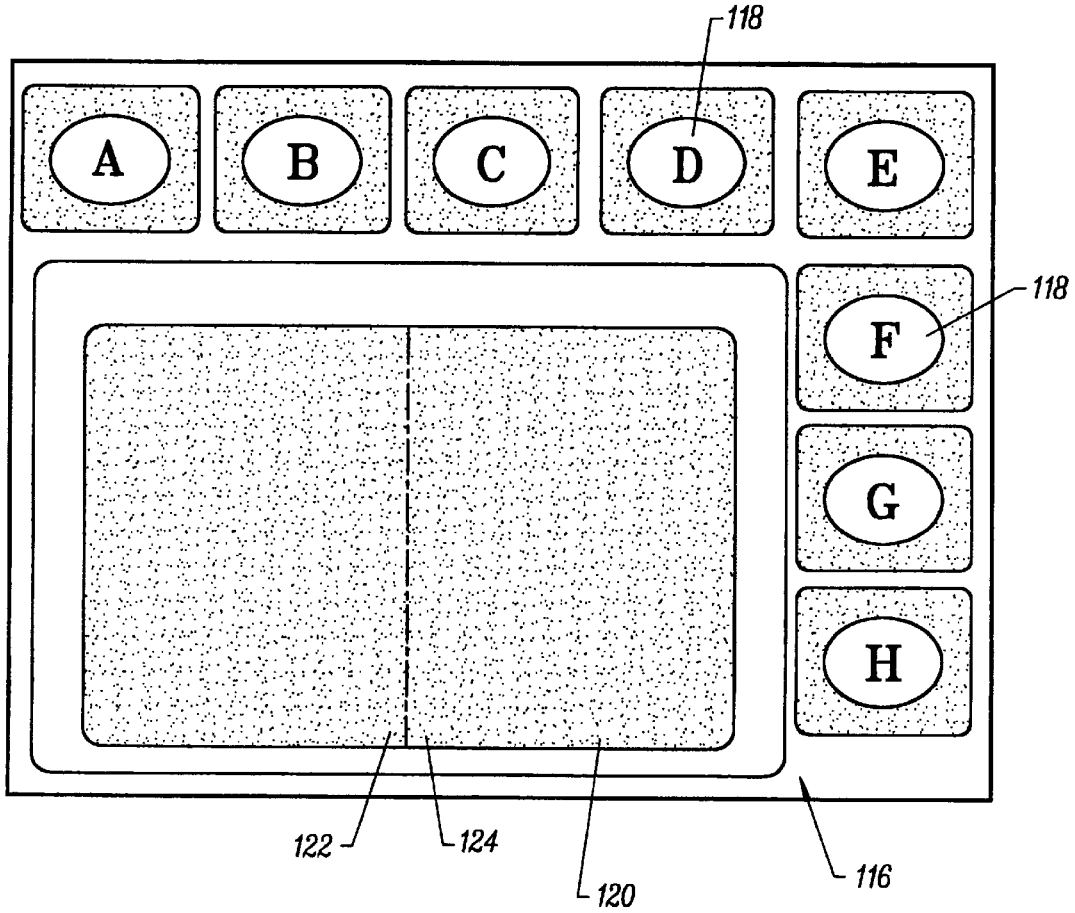
FIG. 6 is a control interface for the present invention as it can be displayed on a monitor.

At least one of the monitors 110, 112, or 114, preferably has a control interface 116 of which one embodiment is illustrated in FIG. 6. The keys 118 along the perimeter of the interface are sized to be actuated with the butt of the student's club to operate the computer. This interface 116 provides direct control to the student over the parameters of the training session such as paging through a lesson, operation of the animation outline or the motion template sequence, view(s) shown, etc. The interface 116 can also provide multiple views of the training session by splitting the screen 120 into the desired number of segments such as 122 and 124. Each segment 122, 124 can display the live feed from one of the video cameras 96, 98, 100, 102, or 104 with a superimposed recorded motion template of an instructor performing the training motion from the identical view. Optionally, multiple views can be displayed on multiple monitors which would replace the first monitor 110, for example.

In operation, a practice session with the present invention begins with the student providing the device 90 with information about the student's gender, age, body type (such as height, weight, etc.) through the control interface 116 or other input means to the computer 108. With this information, the computer 108 presents a list of motion templates 10 of instructors (top performers, in this example, golf pros) whose gender, age and body type approximately match the student. The list is prepared from a stored library of motion templates of male and female top performers with differing ages, body types, etc. The student can preview the motion templates 10, return to the prior input means and adjust the information entered about him or herself, or immediately select a particular top performer.

The student can also provide the computer 108 with a favorite motion template, perhaps containing a previously customized graphic lesson. This favorite motion template can be electronically downloaded or physically carried by the student to the computer 108.

Once the practice session begins with the selected motion template 10, the device 90 enables the student to quantitatively compare the live image of the student while performing the selected motion with a motion template having a stored image of the instructor dynamically performing the selected motion. Should the student's body become misaligned with the instructor's image, the student instantly knows by how much and at which point of the swing the misalignment occurred.

Since the lens characteristics and positions of each of the cameras 96, 98, 100, 102, or 104 in the device 90 are pre-determined relative to the ball position and the line-of-play and identical to those in the device in which the motion template 10 was recorded, the animated outline of the selected motion template 10 approximates the size of the student's body without scaling or otherwise manipulating either the stored image in the motion template or live image of the student. The motion template 10 is immediately ready for use by the student.

The standardization of the lens characteristics and position of the cameras allows one or more motion templates to be used interchangeably between a network of individual devices like device 90. Any motion template 10 prepared in accordance with the standardized lens characteristics and positions of the cameras, will not need to be adjusted for use in different individual devices 90. The student can personally carry, or have delivered, a copy of his or her favorite motion template and use it at devices 90 located at different geographical locations, i.e. golf courses. Then the student can "warm up" with his or her favorite motion template before starting a round of golf, regardless of the course.

A network of standardized devices 90 allows a motion template 10 to be distributed from a centrally located library. For example, a particular motion template 10 can be downloaded from a library remote to the device 90 through a cable, phone line, or other on-line service (i.e., the internet). Alternatively, a disc or tape of the motion template 10 can be shipped to the location of the device 90.

The motion template illustrated in FIGS. 1A–1F and 2A–2F is created as a two dimensional representation of the instructor's dynamic motion. It should be understood that the present invention can use a two-dimensional motion template derived from a three dimensional "capture". An example of a commercially available hardware/software package which could accomplish this includes the EVA Hi-Res system by Motion Analysis Corporation of Santa Rosa, Calif. and three dimensional animation software Cyberscan from Soft Image.

The three dimensional recording can be played back at any angle selected by the student to match or complement the position of the video camera providing the live feed of the student. This is accomplished by placing one or more reference markers in the live video frame that communicate to the computer how to size and position the images. One can walk around the reference marker with the live feed video camera and the motion template will rotate and change as though the instructor were actually standing there. Without the three dimensional "capture" and the reference marker, the image can be adjusted (size and two-dimension position being the only variables) either at the computer or with a remote keyboard at the practice area.

Having generally described the present invention, a further understanding can be obtained by reference to the following specific example, which is provided herein for purposes of illustration only and are not intended to be limiting of the present invention.

The construction of one embodiment of the training device included a computer such as a Commodore Amiga 2000. The computer was equipped with video card such as the Super-Gen video pass-thru module commercially available from Progressive Image Technology. A conventional video cassette recorder (VCR) was connected to the input of the Super-Gen video module. The animation outline was made directly from the video image using the Deluxe Paint IIII program available from Electronic Arts. The instructor's position in each frame of the video image was traced by advancing the VCR frame by frame and using the Deluxe Paint III program's animation function to draw a line around the instructor's body and club. Tracing each frame of the instructor's recorded video resulted in an outline animation of the ideal motion sequence to be emulated by the student. Synthesized sound was added to the animation using the Take 2 program available from Rombo, and the animation runs as used from the Take 2 program.

Figure 7:
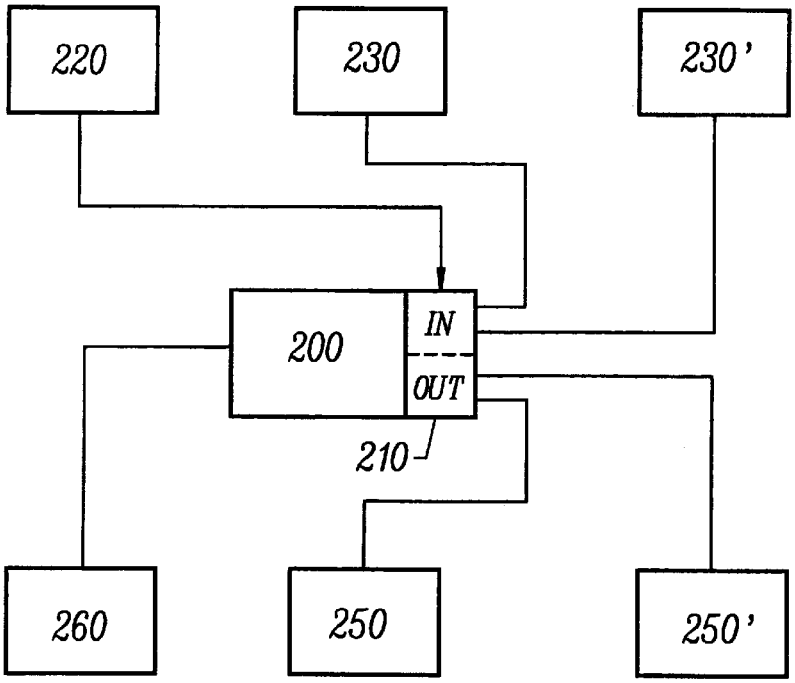
FIG. 7 is a schematic diagram of the constructional arrangement of one embodiment of the present invention indicating the step of creating a motion template.
Figure 8:
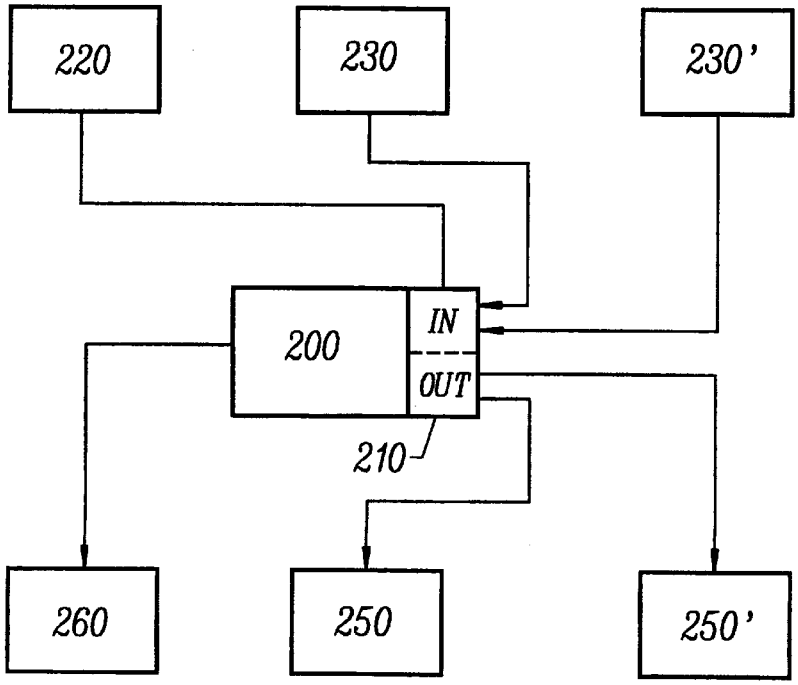
FIG. 8 is a diagram similar to FIG. 7 indicating the function of the device during use by a student.

To use the motion template, the VCR was switched to the output of the Super-Gen video module to record the training session. The video camera was connected to the input of the Super-Gen video module and the animation of the motion template was superimposed over or combined with the live video feed from the video camera. The one or more remote monitors which were to be viewed by the student while performing the training motion were connected to the output of the Super-Gen video module and the audio output on the computer. The particular software limitations of the Deluxe Paint III program required that the animation outline be lined up and sized using the video camera. Other computers equipped with a video card and commercially available animation programs which include sound, are sufficient for use with the present invention. To provide different viewing angles of the background and the student, more than one camera can be provided. In FIGS. 7 and 8, one additional camera is shown. Further, for convenience of the user, more than one monitor could be used for display. In FIGS. 7 and 8, one additional monitor is shown. Each monitor may display the same image, or may display a different image such as at a different viewing angle. The program running the animation also outputs sound from the computer (as wave files) to a speaker. In this way, audio cues and rhythmic reference are used to help the student synchronize his motion with the motion of the instructor or expert. The speaker may be incorporated in the monitor(s).

All or part of the interactive training session with both the motion template and live image of the student can be saved on tape by recording the output from the computer to the viewing monitor or saved directly in the memory of the computer itself. The results can be viewed as part of, or after, the training session.

By practicing at speed wherein the animation outline 12 runs as recorded, the student is able to check his body position (and the position of any equipment being used i.e. a golf club, tennis racquet, or baseball bat) relative to the outline both in terms of geography and flow. After practicing, as the student starts making a few "perfect" movements or swings, the student can animate, or have animated, a video of his or her own motion. The purpose of the self-motion template using one's own body is that it may be preferable to one of someone else. Professionals and experts will have templates made of motions they consider particularly successful, to which they can refer, and update when necessary. This will provide a baseline motion should they fall out of their ideal swing.

The dynamic motion templates may also be used by advancing the animation sequence frame by frame to allow the student to place his body in the perfect position each time and hold it there for as long as necessary to create "muscle memory" for each position. Then the student can attempt to synchronize his or her motion with the template building to normal speed.

By seeing himself or herself "real time", a student at any level of skill can make adjustments toward the instructive motion template while they are performing the movement, with or without the presence of live instructor. As the student repeatedly swings with the instructive motion template, muscle memory and a mental visualization are created which improve his or her skill at performing the motion. In contrast to the traditional training method using verbal keys or feelings experienced during the motion training, the present invention provides a more powerful teaching tool: instantaneous reaction and adaptation to visual stimuli. Essentially, the motion template is the centerpiece in a very flexible biomechanical and mental feedback loop for any motion activity.

In viewing an outline of the actual body of an instructor completing an ideal movement superimposed over a student's image, nuances often become apparent that would not be noticed otherwise. As the student studies the instructor's dynamic motion frame by frame and in continuous motion superimposed over the student's live image, the student is essentially forced to consider aspects of the swing he or she may never have experienced before. Having the student interactively view the action of the instructor's muscles performing an ideal golf swing with a real-time comparison helps develop a sense of balance, timing, and position which is essentially self-taught or self-realized.

The motion template of the present invention also provides psychological inspiration as any student, novice or expert, experiencing the motion template admires the instructor's motion. The motion templates are preferably made from top professionals in their fields. Their movements are as near to perfection as can be attained. To someone struggling to approximate them, they are beautiful. This beauty may be their most important attribute. It should initiate desire. When a student first considers stepping into a template, however, he or she often first experience denial. The student may believe his or her motion may only need a "minor adjustment." This objection often evaporates after the student attempts to fit his or her body into the opening frame, and almost always disappears when they try to swing inside a moving template. Soon, instead of defending his or her problems, the student is asking for help. The first prerequisite to learning is desire. The second is methodology. By giving the student an ideal toward which to strive, and a tireless program of perfect repetition to help them get there, the present invention is designed to provide both.

Numerous modifications and variations of the present invention are possible in light of the above teachings. It is therefore to be understood that within the scope of the appended claims, the invention may be practiced otherwise than as specifically described herein.

What is claimed is:

1. A motion training template for a device enabling a student to interactively emulate in real time the dynamic motion of an instructor performing a selected motion on a monitor simultaneously displaying a live image of the student in a real time background, the monitor configured for viewing by the student while performing the selected motion, the motion template comprising:

a plurality of sequential image frames of the instructor dynamically performing the selected motion retrievably stored on a storage media, the plurality of sequential image frames being configured for superimposing onto the real time background and for simultaneously displaying the resulting combination of the plurality of sequential image frames and the real time background on the monitor, and the view of the plurality of sequential image frames having the same camera angle as the real time background.

2. The motion training template in claim 1 wherein the plurality of sequential image frames is a plurality of sequential animation frames delineating at least the outline of the instructor's body dynamically performing the selected motion.

3. The motion training template in claim 2 wherein at least one of the plurality of sequential animation frames includes highlighting selected contours or surface features of the instructor's body which provides the student with visual assistance in matching corresponding contours or surface features of the student's body as the motion template dynamically progresses through each of the plurality of sequential animation frames.

4. The motion training template in claim 1 wherein the plurality of sequential image frames is a plurality of sequential opaque moving overlays of the instructor's body dynamically performing the selected motion.

5. The motion training template in claim 1 wherein the view of each of the plurality of sequential image frames of the instructor matches the view of the real time background provided by cameras having the lens characteristics and positions.

6. The motion training template in claim 1 wherein the motion template is adapted to provide a plurality of selectable pluralities of sequential image frames of different instructors so that at least one motion template will have the same gender, about the same age, and about the same body type as the student.

7. The motion training template in claim 1 wherein each of the plurality of sequential image frames is a three dimensional capture of the instructor's body dynamically performing the selected motion.

8. The motion training template in claim 1 wherein the motion template includes audio cues to assist the student in synchronizing movement corresponding with the motion template.

9. A motion training device for enabling a student to interactively emulate in real time the dynamic motion of an instructor performing a selected motion, the device comprising:

a video camera configured to transmit a real time background having a live image of the student dynamically performing the selected motion;

a monitor configured for viewing by the student while performing the selected motion;

a motion template having a plurality of sequential stored image frames of the instructor dynamically performing the selected motion; and means for superimposing the motion template onto the real time background and simultaneously displaying the resulting combination of the motion template and the real time background on the monitor.

10. The motion training device in claim 9 wherein the plurality of sequential stored image frames is a plurality of sequential stored animation frames delineating at least the outline of the instructor's body dynamically performing the selected motion.

11. The motion training device in claim 10 wherein each of the plurality of sequential stored animation frames includes highlighting selected contours or surface features of the instructor's body which provides the student with visual assistance in matching corresponding contours or surface features of the student's body as the motion template dynamically progresses through each of the plurality of sequential stored animation frames.

12. The motion training device in claim 9 wherein the plurality of sequential stored image frames is a plurality of sequential stored opaque moving overlay frames of the instructor's body dynamically performing the selected motion.

13. The motion training device in claim 9 wherein each of the plurality of sequential stored image frames is a three dimensional capture of the instructor's body dynamically performing the selected motion.

14. The motion training device in claim 9 wherein the motion template includes audio cues to assist the student in synchronizing movement corresponding with the motion template.

15. The motion training device of claim 9 wherein the superimposing means includes means for generating static visual cues on the combination of the live and recorded images which further assist the student in executing movement corresponding with the motion template.

16. The motion training device in claim 9 wherein the superimposing means includes providing control of the speed at which the sequential plurality of stored image frames of the motion template is played.

17. The motion training device in claim 9 wherein the superimposing means includes controlling the interval time between repetition of the motion template.

18. The motion training device of claim 9 wherein the superimposing means includes adjusting the relative sizes of the sequential plurality of stored image frames of the motion template to provide a substantial matching of the sequential plurality of stored image frames with the live image of the student in the real time background.

19. The motion training device of claim 9 wherein the superimposing means includes changing the view of the sequential plurality of stored image frames of the motion template to provide the same view selected by the student.

20. The motion training device of claim 19 wherein the superimposing means automatically changes the view of the sequential plurality of stored image frames of the motion template by sensing the relative position of a reference marker provided in the real time background.

21. The motion training device of claim 9 wherein the device includes a plurality of video cameras corresponding to different views of the student, the motion template having a plurality of sequential pluralities of stored image frames corresponding to different views of the instructor dynamically performing the selected motion, the monitor providing simultaneous or successive display of one or more of the different views.

22. The motion training device of claim 21 wherein the device further includes a plurality of monitors corresponding to different views of the combined live image of the student in a real time background and the plurality of sequential stored image frames of the motion template.

23. The motion training device of claim 9 wherein the device further includes a means for controlling the speed at which the plurality of sequential stored image frames plays with the ability to stop the sequence at a particular stored image frame within the plurality of sequential stored image frames.

24. The motion training device of claim 9 wherein the device further includes a database having a plurality of motion templates of different instructors, the database being accessible to the student for selecting one of the plurality of motion templates to be used by the superimposing means as the motion template.

25. A motion training device for enabling a student to interactively emulate in real time the dynamic motion of an instructor performing a selected motion, the system comprising:

a video camera configured to transmit a real time background having a live image of the student dynamically performing the selected motion;

a monitor configured for viewing by the student while performing the selected motion;

a motion template having a plurality of sequential stored image frames of the instructor dynamically performing the selected motion, the view of the plurality of sequential stored image frames of the instructor being the same as the view of the real time background provided by video camera wherein the video camera has the same lens characteristics and position as the camera used to record the plurality of sequential stored image frames; and means for superimposing the motion template onto the real time background, simultaneously displaying the resulting combination of the plurality of sequential stored image frames within the motion template and the real time background on the monitor, and automatically repeating the motion template at a selected interval.

26. The motion training device in claim 25 wherein the motion template includes audio cues to assist the student in synchronizing movement corresponding with the motion template.

27. The motion training device in claim 25 wherein each of the stored image frames within the plurality of sequential stored image frames of the motion template is an animation image frame delineating at least the outline of the instructor's body dynamically performing the selected motion.

28. The motion training device in claim 27 wherein at least one of the animation image frames includes highlighting selected contours or surface features of the instructor's body which provides the student with visual assistance in matching corresponding contours or surface features of the student's body as the motion template dynamically progresses through each of the plurality of animation image frames.

29. The motion training device in claim 25 wherein the plurality of sequential image frames is a plurality of sequential opaque moving overlays of the instructor's body dynamically performing the selected motion.

30. A network of motion training devices for enabling students to each interactively emulate in real time the dynamic motion of an instructor performing a selected motion, the network comprising:

a centrally located database having a plurality of motion templates, each motion template having a a plurality of sequential image frames of a different instructor dynamically performing the selected motion; and a plurality of motion training devices, each device including:

a video camera configured to transmit a real time background having a live image of the student dynamically performing the selected motion;

a monitor configured for viewing by the student while performing the selected motion;

means for superimposing one of the plurality of motion templates onto the real time background and simultaneously displaying the resulting combination of the plurality of sequential image frames of the superimposed motion template and the real time background on the monitor; and means for selecting one of the plurality of motion templates from the database and transporting the selected motion template to the superimposing means.

31. A programmed computer for motion training by enabling a student to interactively emulate in real time the dynamic motion of an instructor performing a selected motion, the computer comprising:

an input signal from a video camera configured to transmit a real time background having a live image of the student dynamically performing the selected motion;

an output signal to a monitor configured for viewing by the student while performing the selected motion;

a motion template having a recorded plurality of sequential images of the instructor dynamically performing the selected motion; and means for superimposing each of the recorded plurality of sequential images onto the real time background and simultaneously displaying the resulting combination of the recorded plurality of sequential images and the real time background scene on the monitor.

32. A method of training a student to emulate the dynamic motion of an instructor performing a selected motion, the method comprising the step of:

enabling the student to quantitatively compare a live image of the student while performing the selected motion with a motion template having a plurality of sequential stored images of the instructor dynamically performing the selected motion.

33. A method of training a student to emulate the dynamic motion of an instructor performing a selected motion, the method comprising the steps of:

superimposing a motion template having a plurality of sequential stored images of the instructor dynamically performing the selected motion over a real time background having a live image of the student dynamically performing the selected motion; and displaying the superimposed plurality of sequential stored images and live images for the student to observe while dynamically performing the selected motion.

34. The method of claim 33 wherein the superimposing step includes the steps of:

transmitting the real time background having the live image of the student dynamically performing a selected motion from a video camera to a monitor; and simultaneously providing a motion template having a plurality of sequential recorded images of an instructor dynamically performing the selected motion on the monitor;

the displaying step includes configuring the monitor for viewing by the student while performing the selected motion.

* * * * *